United States Patent [19]

Saitoh

[11] Patent Number: 4,780,384

[45] Date of Patent: Oct. 25, 1988

[54] LIGHT RECEIVING MEMBER WITH PAIRS OF AN α-SI(M) (H,X) THIN LAYER AND AN α-SI(C,N,O,) (H,X) THIN LAYER REPEATEDLY LAMINATED

[75] Inventor: Keishi Saitoh, Nagahama, Japan

[73] Assignee: Canon Kabushiki Kaisha, Tokyo, Japan

[21] Appl. No.: 945,830

[22] Filed: Dec. 24, 1986

[30] Foreign Application Priority Data

Dec. 27, 1985 [JP] Japan ..... 60-292429

[51] Int. Cl.[4] ..... G03G 5/085

[52] U.S. Cl. ..... 430/57; 430/84; 430/95

[58] Field of Search ..... 430/57, 60, 63, 64, 430/65, 66, 67, 84, 95

[56] References Cited

U.S. PATENT DOCUMENTS

| | | | |
|---|---|---|---|
| 4,486,521 | 12/1984 | Misumi et al. | 430/65 |
| 4,522,905 | 6/1985 | Ogawa et a. | 430/65 |
| 4,532,198 | 7/1985 | Saitoh et al. | 430/65 |
| 4,683,184 | 7/1987 | Osawa et al. | 430/57 |
| 4,701,395 | 7/1987 | Wronski | 430/58 |

OTHER PUBLICATIONS

Worthy, W.; Unusual Photoconductors Developed at University of Chicago", Dec. 3, 1984, C&EN, pp. 33, 34.

*Primary Examiner*—John L. Goodrow

*Attorney, Agent, or Firm*—Fitzpatrick, Cella, Harper & Scinto

[57] ABSTRACT

There is provided a light receiving member comprising a first layer and a second layer being laminated on a substrate, said first layer comprising (a) a layer of less than 100 Å in thickness and (b) another layer of less than 100 Å in thickness being laminated one upon the other, said layer (a) being formed of an amorphous material containing silicon atoms as the main constituent atoms and an element for controlling the conductivity and said layer (b) being formed of an amorphous material containing silicon atoms as the main constituent atoms and at least one kind element selected from the group consisting of nitrogen atoms, carbon atoms and oxygen atoms, and said second layer being formed of an amorphous material containing silicon atoms as the main constituent atoms.

3 Claims, 3 Drawing Sheets

LIGHT RECEIVING MEMBER WITH PAIRS OF AN α-SI(M) (H,X) THIN LAYER AND AN α-SI(C,N,O,) (H,X) THIN LAYER REPEATEDLY LAMINATED

FIELD OF THE INVENTION

This invention relates to improved light receiving members sensitive to electromagnetic waves such as light (which herein means in a broader sence those lights such as ultra-violet rays, visible rays, infrared rays, X-rays and γ-rays).

BACKGROUND OF THE INVENTION

For the photoconductive material to constitute an image-forming member for use in solid image pickup device or electrophotography, or to constitute a photoconductive layer for use in image-reading photosensor, it is required to be highly sensitive, to have a high SN ratio [photocurrent (Ip)/dark current (Id)], to have absorption spectrum characteristics suited for the spectrum characteristics of an electromagnetic wave to be irradiated, to be quickly responsive and to have a desired dark resistance. It is also required to be not harmful to living things as well as man upon the use.

Others than these requirements, it is required to have a property to remove a residual image within a predetermined period of time in solid image pickup device.

Particularly for the image-forming member for use in an electrophotographic machine which is daily used as a business machine at office, causing no pollution is indeed important.

From these standpoints, the public attention has been focused on light receiving members comprising amorphous materials containing silicon atoms (hereinafter referred to as "a-Si"), for example, as disclosed in Offenlegungsschriftes Nos. 2746967 and 2855718 which disclose use of the light receiving member as an image-forming member in electrophotography and in Offenlegungsschrift No. 2933411 which discloses use of the light receiving member in an image-reading photosensor.

For the conventional light receiving members comprising a-Si materials, there have been made improvements in their optical, electric and photoconductive characteristics such as dark resistance, photosensitivity, and photoresponsiveness, use-environmental characteristics, economic stability and durability.

However, there are still left subjects to make further improvements in their characteristics in the synthesis situation in order to make such light receiving member practically usable.

For example, in the case where such conventional light receiving member is uscd as an image-forming member in electrophotography with aiming at heightening the photosensitivity and dark resistance, there is often observed a residual voltage on the conventional light receiving member upon use. When it is repeatedly used for a long period of time, fatigue due to the repeated use are accumulated to cause the so-called ghost phenomena inviting residual images.

Further, in the preparation of the conventional light receiving member using an a-Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in a light receiving layer of the light receiving member as the layer constituents.

However, the resulting light receiving layer sometimes is accompanied with defects on the electrical characteristics, photoconductive characteristics and/or breakdown voltage according to the method of incorporating said constituents being employed.

That is, in the case of using the light receiving member having such light receiving layer, the life of a photocarrier generated in the layer with the irradiation of light is not sufficient, the inhibition of a charge injection from the side of the substrate in a dark layer region is not sufficiently carried out, and image defects likely due to a local breakdown phenomenon which is so-called "white oval marks on half-tone copies" or other image defects likely due to abrasion upon using a blade for the cleaning which is so-called "white line" are apt to appear on the transferred images on a paper sheet.

Further, in the case where the above light receiving member is used in a very moist atmosphere, or in the case where after being placed in that atmosphere it is used, the so-called "image flow" sometimes appears on the transferred images on a paper sheet.

Further in addition, in the case of forming a light receiving layer of at least ten mμ in thickness on an appropriate substrate to obtain a light receiving member, the resulting light receiving layer is likely to invite undesired phenomena such as a thinner interslitial space being formed between the bottom face and the surface of the substrate, the layer being removed from the substrate and a crack being generated within the layer following the lapse of time after the light receiving member is taken out from the vacuum deposition chamber.

These phenomena are apt to occur in the case of using a cylindrical substrate which is usually used in the field of electrophotography.

Consequently, it is necessary not only to make a further improvement in an a-Si material itself but also to establish such a light receiving member which does not invite any of the foregoing problems.

SUMMARY OF THE INVENTION

The object of this invention is to provide a light receiving member comprising a light receiving layer mainly composed of a-Si, free from the foregoing problems and capable of satisfying various kinds of requirements.

That is, the main object of this invention is to provide a light receiving member comprising a light receiving layer constituted with a-Si in which electrical, optical and photoconductive properties are always substantially stable barely depending on the working circumstances, and which is excellent resisting optical fatigue, causes no degradation upon repeated use is excellent in durability and moistureproofness, exhibits little or no residual voltage and provides easy production control.

Another object of this invention is to provide a light receiving member comprising a light receiving layer composed of a-Si which has high photosensitivity, high S/N ratio and high electrical voltage withstanding property.

Another object of this invention is to provide a light receiving member comprising a light receiving layer composed of a-Si which is excellent in the close bondability between a support and a layer disposed on the support or between each of the laminated layers, is dense and stable in view of the structural arrangement and is of high layer quality.

A further object of this invention is to provide a light receiving member comprising a light receiving layer composed of a-Si which exhibits a satisfactory charge-maintaining function in the electrification process of forming electrostatic latent images and is excellent in electrophotographic characteristics when it is used in electrophotographic method.

A still further object of this invention is to provide a light receiving member comprising a light receiving layer composed of a-Si which does not foster image defects nor an image flow on the resulting visible images on a paper sheet upon repeated use in a long period of time and which gives highly resolved visible images with clearer half-tone which are highly dense and quality images.

The pesent inventor has made earnest studies for overcoming the foregoing problems on the conventional light receiving members and attaining the objects as described above and, as a result, has accomplished this invention based on the finding as described below.

As a result of the earnest studies focusing on materiality and practical applicability of a light receiving member comprising a light receiving layer composed a-Si for use in electrophotography, solid image-pickup device and image-reading device, the present inventor has obtained the following findings.

That is, the present inventor has found that in case where the light receiving layer composed of an amorphous material containing silicon atoms as the main constituent atoms is so structured as to have a particular two-layer structure as later described, the resulting light receiving member is able to to bring about many practically applicable excellent characteristics especially usable for electrophotography and superior to the conventional light receiving member in any of the characteristics.

In more detail, one of the findings is that in a light receiving member having a light receiving layer composed of an a-Si material disposed on a support, its charge injection inhibition layer, which serves to prevent a charge injection from the side of the substrate, can be formed by incorporating an element for controlling the conductivity in a layer region of the light receiving layer which is adjacent to the support.

A further finding is that when at least one kind selected from nitrogen atoms, carbon atoms and oxygen atoms are incorporated in said layer region, there can be attained improvements in photosensitivity and dark electrical resistivity of the light receiving layer, and also in mutual contact between the light receiving layer and the substrate.

As a result of further studies on the basis of these findings, the present inventor has found that the layer region adjacent to the support is preferably to be formed of an a-Si material containing at least one kind selected from nitrogen atoms, carbon atoms and oxygen atoms, and optionally, hydrogen atoms and/or halogen atoms in addition to an element for controlling the conductivity. [hereinafter, a-Si material containing optionally hydrogen atoms (H) and/or halogen atoms (X) is referred to as "a-Si(H,X,)"]

The present inventor has made successive studies on the disposition of said layer region composed of an a-Si(H,X) material containing an element for controlling the conductivity and at least one kind selected from nitrogen atoms, carbon atoms and oxygen atoms in a light receiving member. As a result, it was found that the charge injection inhibition function of the layer region adjacent to the support and the mutual contact between said layer and said support are further improved in the case where the layer region is formed by laminating a layer composed of an a-Si(H,X) material containing an element for controlling the conductivity and another layer composed of an a-Si(H,X) material containing at least one kind selected from nitrogen atoms, carbon atoms and oxygen atoms one upon the other, than in the case where the layer region adjacent to the support is formed of an a-Si(H,X) material containing an element for controlling the conductivity and at least one kind selected from nitrogen atoms, carbon atoms and oxygen atoms. It was also found that the aforesaid effects are enhanced in the case where the thickness of each of the above two layers to be laminated one upon the other is adjusted to be less than 100 Å.

Accordingly, this invention is to provide an improved light receiving member comprising a first layer and a second layer of less than 1.0 μm in thickness being disposed on a substrate, said first layer comprising (a) a layer of less than 100 Å in thickness and (b) another layer of less than 100 Å in thickness being laminated one upon the other, said layer (a) being formed of an amorphous material containing silicon atoms as the main constituent atoms and an element for controlling the conductivity and said layer (b) being formed of an amorphous material containing silicon atoms as the main constituent atoms and at least one kind element selected from the group consisting of nitrogen atoms, carbon atoms and oxygen atoms, and said second layer being formed of an amorphous material containing silicon atoms as the main constituent atoms.

DETAILED DESCRIPTION OF THE INVENTION

Figure 1:
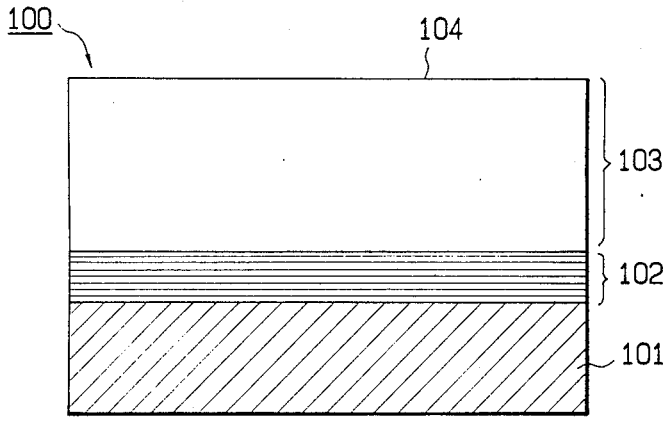
FIG. 1 is a schematic view illustrating the layer constitution of a representative light receiving member according to this invention.

Representative embodiments of the light receiving member according to this invention will now be explained more specifically referring to the drawings. The description is not intended to limit the scope of this invention.

A representative light receiving member of this invention is as shown in FIG. 1, in which is shown a light receiving member 100 comprising substrate 101, first layer 102 and second layer 103 having free surface 104.

Substrate 101

The substrate 101 for use in this invention may either be electroconductive or insulative. The electroconductive support can include, for example, metals such as NiCr, stainless steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1 as image forming member for use in electronic photography, it is desirably configurated into an endless belt or cylindrical form in the case of continuous high speed reproduction. The thickness of the support member is properly determined so that the light receiving member as desired can be formed. In the case flexibility is required for the light receiving member, it can be made as thin as possible within a range capable of sufficiently providing the function as the substrate. However, the thickness is usually greater than 10 μm in view of the fabrication and handling or mechanical strength of the substrate.

First Layer 102

The first layer 102 is disposed between the substrate 101 and the second layer 103 as mentioned in FIG. 1.

The first layer 102 is of less than 1.0 μm in thickness and comprises (a one layer of less than 100 Å in thickness and (b) the other layer of less than 100 Å in thickness being laminated one upon the other, and the layer (a) is composed of an amorphous material containing silicon atoms as the main constituent and an element for controlling the conductivity, particularly, an amorphous material containing silicon atoms (Si) as the main constituent and an element for controlling the conductivity (M), and if necessary, hydrogen atoms (H) and/or halogen atoms (X) [hereinafter referred to as "a-SiM(H,X)"], and the layer (b) is composed of an amorphous material containing silicon atoms (Si) as the main constituent and at least one kind selected from nitrogen atoms (N), carbon atoms (C) and oxygen atoms (0), and if necessary, hydrogen atoms (H) and/or halogen atoms (X) [hereinafter referred to as "a-Si(N,C,O)(H,X)"].

As the element to be contained as the element M in the layer (a) composed of an a-SiM(H,X) material, the so-called impurities in the field of the semiconductor can be mentioned, and those usable herein can include atoms belonging to the group III of the periodic table that provide p-type conductivity (hereinafter simply referred to as "group III atom") or atoms belonging to the group V of the periodic table that provide n-type conductivity (hereinafter simply referred to as "group V atom"). Specifically, the group III atoms can include B (boron), Al (aluminum), Ga (gallium), In (indium) and Ti (thallium), B and Ga being particularly preferred. The group V atoms can include, for example, P (phosphorous), As (arsenic), Sb (antimony) and Bi (bismuth), P and As being particularly preferred.

The amount of the group III atoms or the group V atoms to be contained in the layer (a) is preferably $3\times10$ to $5\times10^4$ atomic ppm, more preferably, $5\times10$ to $1\times t0^4$ atomic ppm, and most preferably, $1\times10^2$ to $5\times10^3$ atomic ppm.

As the halogen atom (X) to be contained either in the layer (a) or the layer (b), there are fluorine, chlorine, bromine and iodine. Among these halogen atoms, fluorine is most preferred.

The amount of the hydrogen atoms (H), the amount of the halogen atoms (X) or the sum of the amounts for the hydrogen atoms and the halogen atoms (H+X) to be incorporated in the first layer is preferably $1\times10^{-2}$ to $4\times10$ atomic %, more preferably, $5\times10^{-2}$ to $3\times10$ atomic %, and most preferably, $1\times10^{-1}$ to 25 atomic %.

The amount of one kind selected from nitrogen atoms (N), carbon atoms (C) and oxygen atoms (0) or the sum of the amounts for two or more kinds of these atoms to be contained in the above layer (b) composed of an a-Si(N,O,C)(H,X) material is preferably $1\times10^{-3}$ to 50 atomic %, more preferably, $2\times10^{-3}$ to 40 atomic %, and, most preferably, $3\times10^{-3}$ to 30 atomic %.

Second Layer 103

The second layer 103 is disposed on the first layer 102, and it is composed of an a-Si material containing silicon atoms as the main component, and if necessary, hydrogen atoms (H) and/or halogen atoms (X) [hereinafter referred to as "a-Si(H,X)"].

The halogen atom (X) includes, specifically, fluorine, chlorine, bromine and iodine. And among these halogen atoms, fluorine and chlorine are particularly preferred. The amount of the hydrogen atoms (H), the amount of the halogen atoms (X) or the sum of the amounts for the hydrogen atoms and the halogen atoms (H+X) to be incorporated in the second layer is preferably $1\times10^{-2}$ to $4\times10$ atomic %, more preferably, $5\times10^{-2}$ to $3\times10$ atomic %, and most preferably, $1\times10^{-1}$ to 25 atomic %.

The thickness of the second layer 103 is an important factor in order to effectively attain the object of this invention, and it is appropriately determined depending upon the desired purpose.

It is, however, also necessary that the layer thickness is determined in view of relative and organic relationships in accordance with the amounts of the halogen atoms and hydrogen atoms contained in the layer or the characteristics required in the relationship with the thickness of other layer. Further, it should be determined also in economical point of view such as productivity or mass productivity. In view of the above, the thickness of the second layer 103 is preferably 1 to 100 μm, more preferably, 1 to 80 μm, and, most preferably, 2 to 50 μm.

As explained above, since the light receiving member of this invention is structured by disposing a special layer of less than 1.0 μm in thickness constituted by laminating two kinds of thin layers respectively of less than 100 Å in thickness one upon the other between a substrate and a light receiving layer, the problems relating to layer peeling from the substrate and other problems relating to charge injection from the side of the substrate often found in the conventional light receiving member upon use do not occur. Further, the light receiving member of this invention exhibits many excellent electric, optical and photoconductive characteristics, excellent breakdown voltage resistance and excellent use-environmental characteristics without being accompanied by any problem found in the conventional light receiving member upon use.

Particularly, in the case of applying the light receiving member to the electrophotography, there are no undesired effects at all of the residual voltage to the image formation, stable electrical properties, high sensitivity and high S/N ratio, excellent light fastness and property for repeating use, high image density and clear half tone and high quality images are provided high resolution power repeatedly.

Preparation of Layers

The method of forming the light receiving layer of the light receiving member will be now explained.

Each of the first layer 102 and the second layer 103 to constitute the light receiving layer of the light receiving member of this invention is properly prepared by a vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the controls for the condition upon preparing the light receiving members having desired properties are relatively easy, and hydrogen atoms, halogen atoms and other atoms can be introduced easily together with silicon atoms. The glow discharging method and the sputtering method may be used together in one identical system.

Basically, when a layer constituted with a-Si(H,X) is formed, for example, by the glow discharging method, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of a-Si(H,X) is formed on the surface of a substrate placed in the deposition chamber.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms, and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$. The use of the gaseous or gasifiable silicon halide as described above is particularly advantageous since the layer constituted with halogen atom-containing a-Si can be formed with no additional use of the gaseous starting material for supplying Si.

The gaseous starting material usable for supplying hydrogen atoms can include those gaseous or gasifiable materials, for example, hydrogen gas, halides such as HF, HCl, HBr, and HI, silicon hydrides such as $SiH_4$, $Si_2H_6$, $Si_3H_8$, and $Si_4H_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms (H), which are extremely effective in view of the control for the electrical or photoelectronic properties, can be controlled with ease. Then, the use of the hydrogen halide or the halogen-substituted silicon hydride as described above is particularly advantageous since the hydrogen atoms (H) are also introduced together with the introduction of the halogen atoms.

The amount of the hydrogen atoms (H), the amount of the halogen atoms (X) or the sum of the amounts for the hydrogen atoms and the halogen atoms (H+X) is preferably from 0.01 to 40 atomic %, preferably, from 0.05 to 30 atomic %, and, most preferably from 0.1 to 25 atomic %.

The amount of the hydrogen atoms (H) and/or the amount of the halogen atoms (X) to be contained in a layer are adjusted properly by controlling related conditions, for example, the temperature of a substrate, the amount of a gaseous starting material capable of supplying the hydrogen atoms or the halogen atoms into a deposition chamber and the electric discharging power.

Now, in the case of forming a layer composed of a-Si(H,X) by the reactive sputtering process, the layer is formed on the substrate by using an Si target and sputtering the Si target in a plasma atmosphere.

To form said layer by the ion-plating process, the vapor of silicon is allowed to pass through a desired gas plasma atmosphere. The silicon vapor is produced by heating polycrystal silicon or single crystal silicon held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms in accordance with the sputtering process, a feed gas to liberate hydrogen is introduced into the deposition chamber in which a plasma atmosphere of the gas is produced. The feed gas to liberate halogen atoms includes the above-mentioned halogen-containing silicon compounds.

For example, in the case of the reactive sputtering process, the layer composed of a-Si(H,X) is formed on the substrate by using an Si target and by introducing a halogen-atom introducing gas and $H_2$ gas, if necessary, together with an inert gas such as He or Ar into a deposition chamber to thereby form a plasma atmosphere and then sputtering the Si target.

In order to form a layer constituted with an amorphous material composed of a-Si(H,X) further incorporated with the group III atoms or the group V atoms using a glow discharging, sputtering or ion plating process, the starting material for introducing the group III or group V atoms is used together with the starting material for forming a-Si(H,X) upon forming the a-Si(H,X) layer while controlling the amount of them in the layer to be formed.

For instance, in the case of forming a layer composed of a-Si(H,X) containing the group III or group V atoms, namely a-SiM(H,X), by using the glow discharging, the starting gaseous material for forming the a-SiM(H,X)

are introduced into a deposition chamber in which a substrate is placed, optionally being mixed with an inert gas such as Ar or He in a predetermined mixing ratio, and the thus introduced gases are exposed to the action of glow discharge to thereby cause a gas plasma resulting in forming a layer composed of a-SiM(H,X) on the substrate.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

Referring to the starting material for introducing the group V atoms and, specifically to, the phosphorous atom introducing materials, they can include, for example, phosphorous hydrides such as $PH_3$ and $P_2H_6$ and phosphorous halides such as $PH_4I$, $PF_3$, $PF_5$, $PCl_3$, $PCl_5$, $PBr_3$, $PBr_5$ and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $SiCl_3$ and $BiBr_3$ can also be mentioned to as the effective starting material for introducing the group V atoms.

In order to form a layer containing nitrogen atoms using the glow discharging process, the starting material for introducing nitrogen atoms is added to the material selected as required from the starting materials for forming said layer as described above. As the starting material for introducing nitrogen atoms, most of gaseous or gasifiable materials which contain at least nitrogen atoms as the constituent atoms can be used.

For instance, it is possible to use a mixture of a gaseous starting material containing silicon atoms (Si) as the constituent atoms, a gaseous starting material containing nitrogen atoms (N) as the constituent atoms and, optionally, a gaseous starting material containing hydrogen atoms (H) and/or halogen atoms (X) as the constituent atoms in a desired mixing ratio, or a mixture of a starting gaseous material containing silicon atoms (Si) as the constituent atoms and a gaseous starting material containing nitrogen atoms (N) and hydrogen atoms (H) as the constituent atoms also in a desired mixing ratio.

Alternatively, it is also possible to use a mixture of a gaseous starting material containing nitrogen atoms (N) as the constituent atoms and a gaseous starting material containing silicon atoms (Si) and hydrogen atoms (H) as the constituent atoms.

The starting material that can be used effectively as the gaseous starting material for introducing the nitrogen atoms (N) used upon forming the layer containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

The layer containing nitrogen atoms may be formed through the sputtering process by using a single crystal or polycrystalline Si wafer or $Si_3N_4$ wafer or a wafer containing Si and $Si_3N_4$ in admixture as a target and sputtering them in various gas atmospheres.

In the case of using a Si wafer as a target, for instance, a gaseous starting material for introducing nitrogen atoms and, as required, hydrogen atoms and/or halogen atoms is diluted optionally with a dilution gas, and introduced into a sputtering deposition chamber to form gas plasmas with these gases and the Si wafer is sputtered.

Alternatively, Si and $Si_3N_4$ may be used as individual targets or as a single target comprising Si and $Si_3N_4$ in admixture and then sputtered in the atmosphere of a dilution gas or in a gaseous atmosphere containing at least hydrogen atoms (H) and/or halogen atoms (X) as the constituent atoms as for the sputtering gas. As the gaseous starting material for introducing nitrogen atoms, those gaseous starting materials for introducing the nitrogen atoms described previously shown in the example of the glow discharging can be used as the effective gas also in the case of the sputtering.

In order to form a layer containing carbon atoms using the glow discharging process, the starting material for introducing carbon atoms is added to the material selected as required from the starting materials for forming said layer as described above. As the starting material for introducing carbon atoms, gaseous or gasifiable materials containing carbon atoms as the constituent atoms can be used.

And it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) and/or halogen atoms (X) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si) in the glow discharging process as described above.

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$)

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In the case of forming a layer containing carbon atoms (C) by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example, an Si wafer as a target, a gaseous starting material for introducing carbon atoms (C) is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

In order to form a layer containing oxygen atoms using the glow discharging process, starting material for introducing the oxygen atoms is added to the material selected as required from the starting materials for forming said layer as described above.

As the starting material for introducing oxygen atoms, most of those gaseous or gasifiable materials which contain at least oxygen atoms as the constituent atoms.

For instance, it is possible to use a mixture of a gaseous starting material containing silicon atoms (Si) as the constituent atoms, a gaseous starting material containing oxygen atoms (O) as the constituent atom and, as required, a gaseous starting material containing hydrogen atoms (H) and/or halogen atoms (X) as the constituent atoms in a desired mixing ratio, a mixture of gaseous starting material containing silicon atoms (Si) as the constituent atoms and a gaseous starting material containing oxygen atoms (O) and hydrogen atoms (H) as the constituent atoms in a desired mixing ratio, or a mixture of gaseous starting material containing silicon atoms (Si) as the constituent atoms and a gaseous starting material containing silicon atoms (si), oxygen atoms (O) and hydrogen atoms (H) as the constituent atoms.

Further, it is also possible to use a mixture of a gaseous starting material containing silicon atoms (Si) and hydrogen atoms (H) as the constituent atoms and a gaseous starting material containing oxygen atoms (O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

In the case of forming a layer containing oxygen atoms by way of the sputtering process, it may be carried out by sputtering a single crystal or polycrystalline Si wafer or $SiO_2$ wafer, or a wafer containing Si and $SiO_2$ in admixture as a target and sputtered in various gas atmospheres.

For instance, in the case of using the Si wafer as the target, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafer is sputtered.

Alternatively, sputtering may be carried out in the atmosphere of a dilution gas or in a gas atmosphere containing at least hydrogen atoms (H) and/or alogen atoms (X) as constituent atoms as a sputtering gas by using individually Si and $SiO_2$ targets or a single Si and $SiO_2$ mixed target. As the gaseous starting material for introducing the oxygen atoms, the gaseous starting material for introducing the oxygen atoms shown in the examples for the glow discharging process as described above can be used as the effective gas also in the sputtering.

For the formation of a light receiving layer of the light recieving member of this invention by means of the glow discharging process, sputtering process or ion plating process, the content of the oxygen atoms, carbon atoms, nitrogen atoms or the group III or V atoms to be introduced into a-Si(H,X) is controlled by controlling the gas flow rate and the ratio of the gas flow rate of the starting materials entered in the deposition chamber.

The conditions upon forming the light receiving layer, for example, the temperature of the support, the gas pressure in the deposition chamber and the electric discharging power are important factors for obtaining a light receiving member having desired properties and they are properly selected while considering the functions of the layer to be formed. Further, since these layer forming conditions may be varied depending on the kind and the amount of each of the atoms contained in the light receiving layer, the conditions have to be determined also taking the kind or the amount of the atoms to be contained into consideration.

Specifically, the temperature of the support is preferably from 50° to 350° C. and, most preferably, from 50° to 250° C. The gas pressure in the deposition chamber is preferably from 0.01 to 1 Torr and, most preferably, from 0.1 to 0.5 Torr. Further, the electrical discharging power is preferably from 0.005 to 50 W/cm$^2$, more preferably, from 0.01 to 30 W/cm$^2$ and, most preferably, from 0.01 to 20 W/cm$^2$.

However, the actual conditions for forming the layer such as temperature of the support, discharging power and the gas pressure in the deposition chamber can not usually the determined with ease independently of each other. Accordingly, the conditions optimal to the layer formation are desirably determined based on relative and organic relationships for forming the amorphous material layer having desired properties.

DESCRIPTION OF THE PREFERRED EMBODIMENTS

The invention will be described more specifically while referring to Examples 1 through 7, but the invention is not intended to limit the scope only to these Examples.

Figure 2:
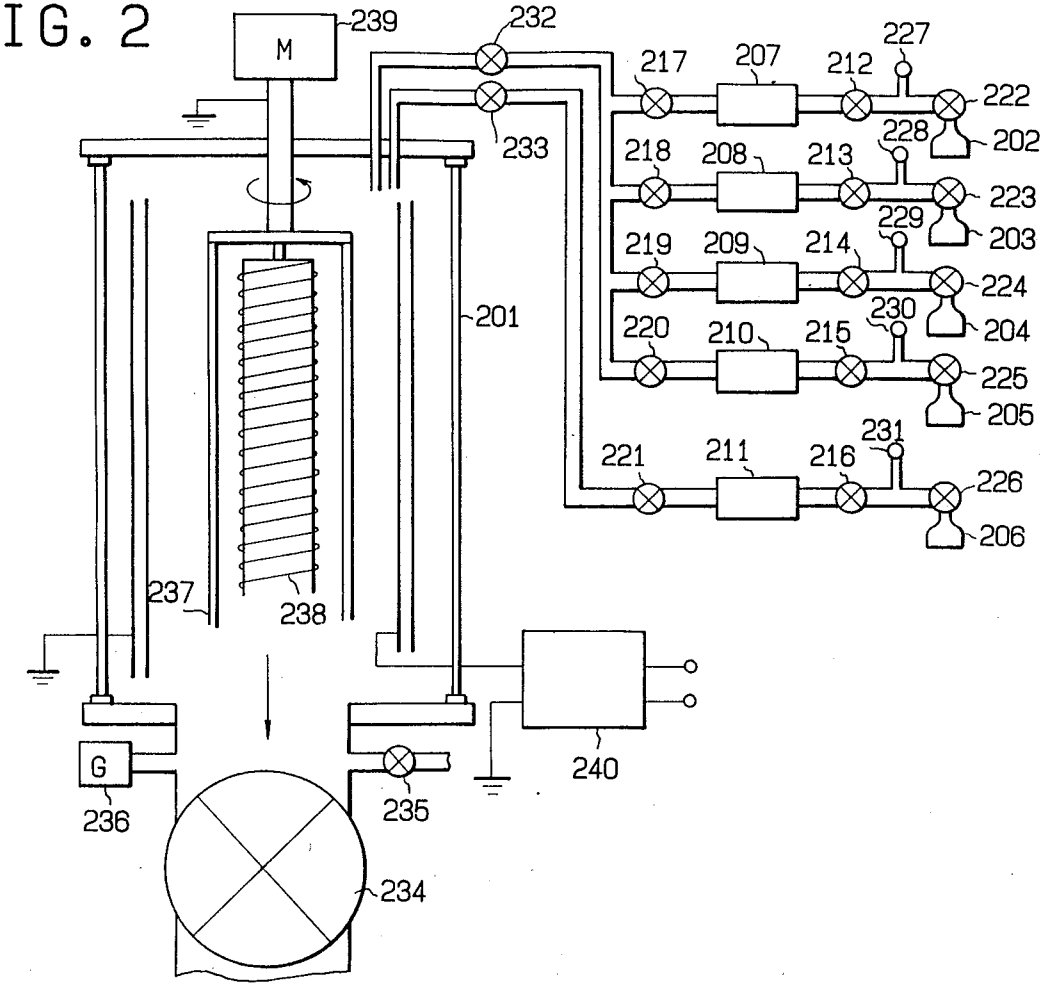
FIG. 2 is a schematic explanatory view of a fabrication apparatus for preparing the light receiving member according to this invention.

In each of the Examples, the first layer 102 and the second layer 103 were respectively formed using the glow discharging fabrication apparatus shown in FIG. 2.

Gas reservoirs 202, 203, 204, 205, and 206 illustrated in the figure are charged with gaseous starting materials for forming the respective layers in this invention, that is, for instance, $SiH_4$ gas (99.999% purity) diluted with He (hereinafter referred to as "$SiH_4$/He gas") in the reservoir 202, $PH_3$ gas (99.999% purity) diluted with He (hereinafter referred to as "$PH_3$/He gas") in the reservoir 203, $B_2H_6$ gas (99.999% purity) diluted with He (hereinafter referred to as "$B_2H_6$/He gas") in the reservoir 204, $SiF_4$ gas (99.999% purity) diluted with He (hereinafter referred to as "$SiF_4$/He gas") in the reservoir 205, and $NH_3$ gas in the reservoir 206.

Prior to the entrance of these gases into a reaction chamber 201, it is confirmed that valves 222 through 226 for the gas reservoirs 202 through 206 and a leak valve 235 are closed and that inlet valves 212 through 216, exit valves 217 through 221, and sub-valves 232 and 233 are opened. Then, a main valve 234 is at first opened to evacuate the inside of the reaction chamber 201 and gas piping.

Then, upon observing that the reading on the vacuum 236 became about $5\times10^{-6}$ Torr, the sub-valves 232 and 233 and the exit valves 217 through 221 are closed.

Now, reference is made to an example in the case of forming the first layer 102 or an Al cylinder as a substrate 237.

$SiH_4$/He gas from the gas reservoir 202 and $PH_3$/He gas from the gas reservoir 203 are caused to flow into mass flow controllers 207 and 208, respectively by gradually opening the inlet valves 212 and 213, controlling the pressure of exit pressure gauges 227 and 228 to 1 kg/cm$^2$. Subsequently, the exit valves 217 and 218, and the sub-valve 232 are gradually opened to discharge the gases into the reaction chamber 201.

In this case, the exit valves 217 and 218 are adjusted so as to attain a desired value for the ratio among the $SiH_4$/He gas flow rate and the $PH_3$/He gas flow rate, and the opening of the main valve 234 is adjusted while observing the reading on the vacuum gauge 236 so as to obtain a desired value for the pressure inside the reaction chamber 201. Then, after confirming that the temperature of the Al cylinder 237 has been set by a heater 238 within a range from 50° to 400° C., a power source 240 is set to a predetermined electrical power to cause glow discharging in the reaction chamber 201 while controlling the above gas flow rates to thereby form a layer containing phosphorus atoms.

After a predetermined period of time, closing the exit valve 218 for the $PH_3$/He gas, the thickness of the layer containing phosphorus atoms to be formed can be appropriately controlled. Successively, opening the exit valve 221, the film forming process is continued while causing glow discharging under predetermined conditions to thereby form a layer on the above layer.

The first layer 102 can be prepared by repeating the above two kinds of the film forming processes.

In the case where introducing halogen atoms into the second layer is desired, $SiF_4$/He gas, for instance, is further introduced into the reaction chamber 201.

In order to form a layer composed of a-Si(H,X) as the second layer 103 on the previously formed layer as the first layer 102, operating the corresponding valves in the same manner as in the case of forming the first layer, for instance, $SiH_4$ gas, if necessary, diluted with a diluting gas such as He, is introduced into the reaction chamber 201 at a predetermined flow rate while causing glow discharging under predetermined conditions to thereby form said layer.

All of the exit valves other than those required for upon forming the respective layers are of course closed. Further, upon forming the respective layers, the inside of the system is once evacuated to a high vacuum degree as required by closing the exit valves 217 through 221 while opening.

EXAMPLE 1

In this example, there was used a glass plate 7059, a production by Corning Glass Works of U.S.A., as the substrate.

The glass plate was firmly disposed on the surface of the Al cylinder which was already placed on the substrate holder of the fabrication apparatus shown in FIG. 2.

Then, three kinds of samples were separately prepared on the respective glass plates under the conditions shown in Table 1; a layer composed of an a-Si material doped with boron atoms and phosphorus atoms as Sample 1, a layer comprising an a-SiN layer and a layer composed of an a-Si material doped with boron atoms and phosphorus atoms being laminated one upon the other for 166 times as Sample 2, and an a-SiN layer doped with boron atoms and phosphorus atoms as Sample 3.

A comb line Al electrode was formed on the surface of each of the samples in accordance with the known vacuum deposition method. And an electric dark conductivity was measured for each of the resulting sample products.

Figure 3:
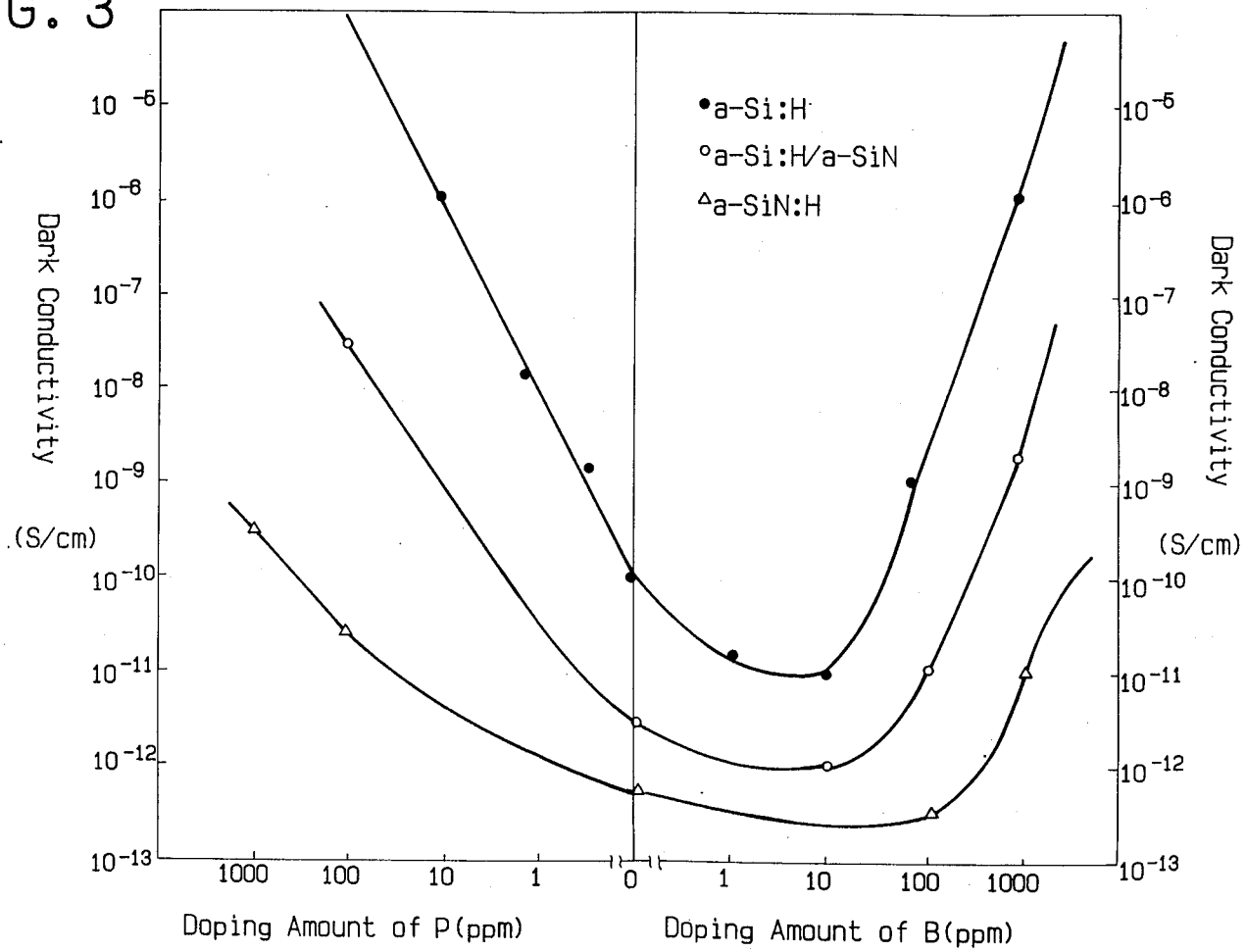
FIG. 3 is an explanatory view of the doping effects of impurities in Example 1.

The results were as shown in FIG. 3, in which the ordinate stands for the electric dark conductivity and the abscissa stands for the doping amount of phosphorus atoms and that of boron atoms respectively.

From the results shown in FIG. 3, it can be understood that the doping effect of Sample 2 is clearly superior to that of Sample 3.

TABLE 1

| Sample | Layer Constitution | Gas used | Flow rate (SCCM) | Flow ratio | Discharging power (W/cm$^2$) | Film forming speed (Å/sec) | Layer thickness (μ) | Remarks |
|---|---|---|---|---|---|---|---|---|
| 1 | Amorphous silicon layer | $SiH_4$, $H_2$<br>$B_2H_6/H_2$ = 3000 ppm<br>$PH_3/H_2$ = 3000 ppm | $SiH_4$ = 100<br>$H_2$ = 300 | $\frac{B_2H_6}{SiH_4}$ = 1–1000 ppm<br>$\frac{PH_3}{SiH_4}$ = 1–1000 ppm | 0.2 | 7 | 1.0 | |
| 2 | Layer comprising an amorphous silicon layer and an amorphous Amorphous Si:N layer | $SiH_4$<br>$N_2$ | $SiH_4$ = 10<br>$N_2$ = 1000 | $\frac{SiH_4}{N_2} = \frac{1}{100}$ | 0.05 | 0.7 | 30Å | The layer thickness was made to be less than 0.1 μm by laminating |

TABLE 1-continued

| Sample | Layer Constitution | | Gas used | Flow rate (SCCM) | Flow ratio | Discharging power (W/cm²) | Film forming speed (Å/sec) | Layer thickness (μ) | Remarks |
|---|---|---|---|---|---|---|---|---|---|
| | Si:N layer being laminated one upon the other | Amorphous silicon layer | $SiH_4$, $H_2$ $B_2H_6/H_2$ = 3000 ppm $PH_3/H_2$ = 3000 ppm | $SiH_4$ = 50 $H_2$ = 300 | $\frac{B_2H_6}{SiH_4}$ = 1-1000 ppm $\frac{PH_3}{SiH_4}$ = 1-1000 ppm | 0.05 | 0.5 | 30Å | layers A and B one upon the other by 166 times |
| 3 | Amorphous Si:N layer | | $SiH_4$, $N_2$ $B_2H_6/H_2$ = 3000 ppm $PH_3/H_2$ = 3000 ppm | $SiH_4$ = 50 $N_2$ = 200 | $\frac{B_2H_6}{SiH_4}$ = 1-1000 ppm $\frac{PH_3}{SiH_4}$ = 1-1000 ppm | 0.2 | 3 | 1.0 | |

EXAMPLE 2

A light receiving member 100 having the first layer 102 and the second layer 103 on the substrate 101 as shown in FIG. 1 for use in electrophotography was prepared by forming the respective layers on an Al cylinder under the film forming conditions shown in Table 2 in the same manner as in Example 1 using the fabrication apparatus shown in FIG. 2.

The resulting light receiving member was applied positive corona discharge with a power source voltage of 5.0 KV for 0.3 second, and soon after this, the image exposure was conducted by irradiating an exposure quantity of 2 lux.sec through a transparent test chart using a tungsten lamp as a light source. Then, the image was developed with a negatively charged toner (containing a toner and a toner carrier) in accordance with the cascade method to develop an excellent toner image on the member surface.

The developed image was transferred to a transfer paper by applying positive corona discharge with a power source voltage of 5.0 KV and then fixed so that an extremely sharp image with a high resolution was obtained.

Further, when electrification ability and residual voltage were measured on the light receiving member using the known measuring device, there was 5 V for the residual voltage.

From these results, it was found that the resulting light receiving member has a wealth of many practically applicable characteristics.

TABLE 2

| Layer constitution | Gas used | Flow rate (SCCM) | Flow ratio | Discharging power (W/cm²) | Film forming speed (Å/sec) | Layer thickness (μ) | Remarks |
|---|---|---|---|---|---|---|---|
| First Layer | | | | | | | |
| Layer A | $SiH_4$ $N_2$ | $SiH_4$ = 10 $N_2$ = 1000 | $\frac{SiH_4}{N_2} = \frac{1}{100}$ | 0.05 | 0.7 | 30Å | Two layers A and B were continuously laminated |
| Layer B | $SiH_4$ $H_2$ $B_2H_6/H_2$ = 3000 ppm | $SiH_4$ = 10 $H_2$ = 100 | $\frac{B_2H_6}{SiH_4}$ = 1000 ppm $\frac{SiH_4}{H_2} = \frac{1}{10}$ | 0.05 | 0.2 | 30Å | one upon the other by 166 times to be less than 1.0 μm for the thickness of the first layer |
| Second layer | $SiH_4$ $H_2$ | $SiH_4$ = 300 $H_2$ = 300 | $\frac{SiH_4}{H_2}$ = 1 | 0.2 | 14 | 23μ | |

EXAMPLES 3 to 6

Light receiving layers were formed on Al cylinders as used in Example 2 in accordance with the film forming conditions shown in each of Tables 3 through 6 in the same manner as in Example 1 using the fabrication apparatus shown in FIG. 2 to obtain light receiving members for use in electrophotography.

The resulting light receiving members were tested in accordance with the same procedures as in Example 2, except that negative discharging polarity and positive developing polarity were employed for the light receiving members in Examples 3 and 5, and positive discharging polarity and negative developing polarity were employed for the light receiving members in Examples 4 and 6, and excellent results were obtained on any of the light receiving members as well as in the case of Example 2.

TABLE 3

| Layer constitution | Gas used | Flow rate (SCCM) | Flow ratio | Discharging power ($W/cm^2$) | Film forming speed (Å/sec) | Layer thickness ($\mu$) | Remarks |
|---|---|---|---|---|---|---|---|
| First layer | | | | | | | |
| Layer A | $SiH_4$<br>$N_2$ | $SiH_4 = 10$<br>$N_2 = 1000$ | $\frac{SiH_4}{N_2} = \frac{1}{100}$ | 0.05 | 0.7 | 30Å | Two layers A and B were continuously laminated one upon the other by 166 times to be less than 1.0 $\mu$m for the thickness of the first layer |
| Layer B | $SiH_4$<br>$H_2$<br>$PH_3/H_2 = 3000$ ppm | $SiH_4 = 10$<br>$H_2 = 100$ | $\frac{PH_3}{SiH_4} = 1000$ ppm<br>$\frac{SiH_4}{H_2} = \frac{1}{10}$ | 0.05 | 0.2 | 30Å | |
| Second layer | $SiH_4$<br>$H_2$ | $SiH_4 = 300$<br>$H_2 = 300$ | $\frac{SiH_4}{H_2} = 1$ | 0.2 | 14 | 23$\mu$ | |

TABLE 4

| Layer constitution | Gas used | Flow rate (SCCM) | Flow ratio | Discharging power ($W/cm^2$) | Film forming speed (Å/sec) | Layer thickness ($\mu$) | Remarks |
|---|---|---|---|---|---|---|---|
| First layer | | | | | | | |
| Layer A | $SiH_4$<br>$SiF_4$<br>$N_2$ | $SiH_4 = 5$<br>$SiF_4 = 5$<br>$N_2 = 1000$ | $\frac{(SiH_4 + SiF_4)}{N_2} = \frac{1}{100}$ | 0.07 | 0.7 | 30Å | Two layers A and B were continuously laminated one upon the other by 166 times to be less than 1.0 $\mu$m for the thickness of the first layer |
| Layer B | $SiH_4$<br>$SiF_4$<br>$H_2$<br>$B_2H_6/H_2 = 3000$ ppm | $SiH_4 = 5$<br>$SiF_4 = 5$<br>$H_2 = 100$ | $\frac{B_2H_6}{(SiH_4 + SiF_4)} = 1000$ ppm<br>$\frac{(SiH_4 + SiF_4)}{H_2} = \frac{1}{10}$ | 0.07 | 0.2 | 30Å | |
| Second layer | $SiH_4$<br>$SiF_4$<br>$H_2$ | $SiH_4 = 200$<br>$SiF_4 = 100$<br>$H_2 = 300$ | $\frac{(SiH_4 + SiF_4)}{H_2} = 1$ | 0.4 | 14 | 23$\mu$ | |

TABLE 5

| Layer constitution | Gas used | Flow rate (SCCM) | Flow ratio | Discharging power ($W/cm^2$) | Film forming speed (Å/sec) | Layer thickness ($\mu$) | Remarks |
|---|---|---|---|---|---|---|---|
| First layer | | | | | | | |
| Layer A | $SiH_4$<br>$N_2$ | $SiH_4 = 10$<br>$N_2 = 1000$ | $\frac{SiH_4}{N_2} = \frac{1}{100}$ | 0.05 | 0.7 | 30Å | Two layers A and B were continuously laminated one upon the other by 166 times to be less than 1.0 $\mu$m for the thickness of the first layer |
| Layer B | $SiH_4$<br>$H_2$<br>$B_2H_6/H_2 = 3000$ ppm | $SiH_4 = 10$<br>$H_2 = 100$ | $\frac{B_2H_6}{SiH_4} = 1000$ ppm<br>$\frac{SiH_4}{H_2} = \frac{1}{10}$ | 0.05 | 0.2 | 30Å | |
| Second layer | $SiH_4$<br>$SiF_4$<br>$H_2$ | $SiH_4 = 250$<br>$SiF_4 = 50$<br>$H_2 = 300$ | $\frac{(SiH_4 + SiF_4)}{H_2} = 1$ | 0.27 | 14 | 23$\mu$ | |

TABLE 6

| Layer constitution | Gas used | Flow rate (SCCM) | Flow ratio | Dishcarging power ($W/cm^2$) | Film forming speed (Å/sec) | Layer thickness (μ) | Remarks |
|---|---|---|---|---|---|---|---|
| First layer | | | | | | | |
| Layer A | $SiH_4$<br>$SiF_4$<br>$N_2$ | $SiH_4 = 5$<br>$SiF_4 = 5$<br>$N_2 = 1000$ | $\frac{(SiH_4 + SiF_4)}{N_2} = \frac{1}{100}$ | 0.07 | 0.7 | 30Å | Two layers A and B were continuously laminated one upon the other by 166 times to be less than 1.0 μm for the thickness of the first layer |
| Layer B | $SiH_4$<br>$SiF_4$<br>$H_2$<br>$B_2H_6/H_2 = 3000$ ppm | $SiH_4 = 5$<br>$SiF_4 = 5$<br>$H_2 = 100$ | $\frac{B_2H_6}{(SiH_4 + SiF_4)} = 1000$ ppm<br>$\frac{(SiH_4 + SiF_4)}{H_2} = \frac{1}{10}$ | 0.07 | 0.2 | 30Å | |
| Second layer | $SiH_4$<br>$H_2$ | $SiH_4 = 300$<br>$H_2 = 300$ | $\frac{SiH_4}{H_2} = 1$ | 0.2 | 14 | 23μ | |

EXAMPLE 7

The procedures of Example 2 were repeated, except that the film forming conditions shown in Table 8 were employed for the formation of the first layer, to obtain light receiving members (Samples No. 801 through 808) for use in electrophotography.

When electrophotographic characteristics were tested for each of the light receiving members, the results as shown in Table 7 were obtained.

TABLE 7

| | Sample Number | | | | | | | |
|---|---|---|---|---|---|---|---|---|
| | 801 | 802 | 803 | 804 | 805 | 806 | 807 | 808 |
| Thickness of each of layers A and B | 5 Å | 10 Å | 20 Å | 50 Å | 70 Å | 100 Å | 200 Å | 500 Å |
| Repeated times* | 1000 | 500 | 250 | 100 | 71 | 50 | 25 | 10 |
| Electrophotographic characteristics | Δ | ○ | ◎ | ◎ | ○ | Δ | X | X |

*The thickness of the first layer was made to be less than 1.0 μm
◎: Excellent
○ : Good
Δ: Applicable for practical use
X: poor

What we claim is:

1. An improved light receiving member comprising a substrate and a light receiving layer constituted by a first layer and a second layer being laminated in this order on said substrate; said first layer being of less than 1 micron in thickness and comprising (i) a thin layer (A) less than 100 Å in thickness and (ii) another thin layer (B) less than 100 Å in thickness, said layers (A) and (B) being laminated together in a plurality of pairs; said thin layer (A) being formed from an amorphous material containing silicon atoms as the main constituent, a conductivity controlling element selected from the group consisting of the elements of Group III and the elements of Group V of the Periodic Table in an amount of 0.003 to 5 atomic percent, and at least one kind selected from hydrogen atoms and halogen atoms in a total amount of 0.01 to 40 atomic percent; said thin layer (B) being formed from an amorphous material containing silicon atoms as the main constituent, at least one kind selected from nitrogen atoms, oxygen atoms and carbon atoms in a total amount of 0.001 to 50 atomic percent and at last one kind selected from hydrogen atoms and halogen atoms in a total amount of 0.01 to 40 atomic percent; and said second layer being formed from an amorphous material containing silicon atoms as the main constituent and at least one kind selected from hydrogen atoms and halogen atoms in a total amount of 0.01 to 40 atomic percent.

2. The improved light receiving member according to claim 1, wherein said second layer is from 1 to 100 microns in thickness.

3. An electrophotographic process comprising:

(a) applying a charge to the light receiving member of claim 1; and (b) applying an electromagnetic wave to said light receiving member, thereby forming an electrostatic image.

* * * * *